US006427855B2

(12) United States Patent
LaBruna, Jr. et al.

(10) Patent No.: US 6,427,855 B2
(45) **Date of Patent: *Aug. 6, 2002**

(54) MODULAR DISPLAY SYSTEM

(75) Inventors: Angelo J. LaBruna, Jr., La Cañada, CA (US); Anthony J. Maldonado, Fanwood, NJ (US)

(73) Assignees: Labruna Industries, Incorporated, Ontario, CA (US); Ann Taylor, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/500,091

(22) Filed: Feb. 8, 2000

Related U.S. Application Data

(60) Provisional application No. 60/132,675, filed on May 5, 1999.

(51) Int. Cl.[7] ..... A47F 5/08
(52) U.S. Cl. ..... 211/87.01; 211/187; 211/90.02
(58) Field of Search ..... 211/87.01, 86.01, 211/103, 90.01, 90.02, 90.04, 187; 108/108

(56) References Cited

U.S. PATENT DOCUMENTS

| | | | | | |
|---|---|---|---|---|---|
| 2,639,042 | A | | 5/1953 | Lambert et al. | 211/147 |
| 2,767,513 | A | * | 10/1956 | Bluestone | 45/139 |
| 2,810,598 | A | * | 10/1957 | Lief | 287/119 |
| 2,855,037 | A | * | 10/1958 | Stiffel | 160/135 |
| 3,035,708 | A | * | 5/1962 | Freeman | 211/86 |
| 3,093,362 | A | * | 6/1963 | Schaefer | 254/86 |
| 3,152,670 | A | * | 10/1964 | Selkregg, Jr. et al. | 189/36 |
| 3,229,822 | A | * | 1/1966 | Janus | 211/134 |
| 3,339,751 | A | * | 9/1967 | Bard | 211/176 |
| 3,468,430 | A | | 9/1969 | Lawman | 211/182 |
| 3,538,842 | A | * | 11/1970 | Labbato | 108/29 |
| 3,612,287 | A | | 10/1971 | Maltese | 211/86 |
| 3,648,419 | A | * | 3/1972 | Marks | 52/36 |
| 3,655,159 | A | * | 4/1972 | Held, Jr. | 248/188.1 |
| 3,711,053 | A | * | 1/1973 | Drake | 248/298 |
| 3,713,257 | A | * | 1/1973 | Beavers | 52/36 |
| 3,945,743 | A | * | 3/1976 | Koch | 403/290 |
| 4,240,766 | A | * | 12/1980 | Smith et al. | 404/10 |
| 4,570,402 | A | * | 2/1986 | Johnson | 52/241 |
| 4,966,343 | A | * | 10/1990 | Bessinger et al. | 248/243 |
| 5,305,898 | A | * | 4/1994 | Merl | 211/87 |
| 5,503,358 | A | | 4/1996 | Lapp | 248/235 |
| 5,527,054 | A | * | 6/1996 | Williams | 280/475 |
| 5,641,081 | A | * | 6/1997 | Merl | 211/103 |

(List continued on next page.)

*Primary Examiner*—Daniel P. Stodola
*Assistant Examiner*—Khoa Tran
(74) *Attorney, Agent, or Firm*—Christie, Parker & Hale, LLP

(57) ABSTRACT

The modular display system having multiple sections which would be placed around the perimeter walls of a retail store. Each section includes two posts for attachment of brackets which hold the horizontal shelves for the merchandise. Each post comprises two perimeter standards positioned vertically. Each perimeter standard is slidably engaged within a vertical sleeve for structural rigidity. Positioned at the bottom of each standard is a foot bracket which is secured to the floor. The height of the display system is adjusted by having a leveler adjustment screw which extends into the foot and into a leveler arm positioned in between the two standard sleeves adjacent the floor. Two outriggers extend from in between the two standard sleeves to an outrigger bracket which is mounted on the wall. Preferably, the two outriggers are positioned in the general vicinity of the top and the bottom of the vertical standards. The outrigger and the outrigger bracket allow for adjustment of the system with respect to the wall. A top rail extends across the top of the perimeter standards. The display system provides for adjustment of both the height and the distance away from the wall to accommodate irregularities in the floor and the wall surfaces of a store.

20 Claims, 5 Drawing Sheets

U.S. PATENT DOCUMENTS 5,657,884 A * 8/1997 Zilinear, III ..... 211/86.01
5,660,286 A * 8/1997 Shea ..... 211/87.01
5,755,430 A * 5/1998 Couch ..... 254/420
5,758,988 A 6/1998 Theodorou ..... 403/331
5,797,501 A 8/1998 Von Gunten ..... 211/90.01
5,848,711 A 12/1998 Schmit ..... 211/90.04
5,918,750 A * 7/1999 Jackson ..... 211/189
6,029,833 A * 2/2000 Yeh ..... 211/189
6,044,986 A * 4/2000 Wood ..... 211/87.01

* cited by examiner

MODULAR DISPLAY SYSTEM

CROSS-REFERENCE TO RELATED APPLICATION

This application claims priority from U.S. Provisional Application No. 60/132,675, filed May 5, 1999.

FIELD OF THE INVENTION

The present invention relates to modular display systems for display of clothing merchandise and other retail items, and more particularly relates to modular display systems that provide for adjustment both in height and in the distance away from the wall to accommodate irregularities in the floor and the wall surfaces of a store.

BACKGROUND OF THE INVENTION

Retail merchants desire display systems that are durable, strong, capable of handling relatively heavy displays, as well as aesthetically pleasing to the customers and capable of efficiently utilizing available floor space. It is important that the display system be designed in a manner that would not place the customers in any danger. This would require that the display system be balanced and stable. In most stores, there are irregularities in the surfaces of the walls and the floor. The floor, for instance, may have a slight slope. Display systems placed on an uneven floor will not be plumb and will not be properly seated against a wall. Uneven and wobbly display systems could topple, especially if loaded with heavy items, thereby placing customers in grave danger. Accordingly, there is a need for a modular display system that is stable and balanced and can accommodate irregularities in the floor or wall surfaces.

For additional protection, it is desirable to securely fasten the display system to a wall to ensure that the unit will not collapse if its equilibrium is disturbed. A display system that is not secured to the wall can be toppled if a customer accidentally bumps into the display unit or in the event of an earthquake. In addition to securing the unit as a whole, the individual components of the display systems must also be securely fastened to ensure that any risk of injury to customers is minimized.

To ensure a stable fixation to a support, some display systems are permanently attached to the wall or floor. The problem with a permanently fixed display system, however, is that it hinders the changing merchandising display needs of retail merchants. It would be expensive and time consuming to continuously change the permanently fixed display systems. Accordingly, there is a need for modular display units that can be changed and rearranged between multiple positions with relative ease and without damaging the finish of the unit. Additionally, it is desirable to have display units that can easily be combined with other display units in the store to form larger, compound units, if necessary.

SUMMARY OF THE INVENTION

The modular display system of the present invention contains multiple sections which would be placed around the perimeter walls of a retail store. Each section includes two vertical posts for attachment of brackets which hold the horizontal shelves for the merchandise. Each post comprises two perimeter standards positioned vertically. Each perimeter standard is slidably engaged within a vertical sleeve for structural rigidity. Positioned at the bottom of each standard is a foot bracket which is secured to the floor. The height of the display system is adjusted by having a leveler adjustment screw which extends into the foot and into a leveler arm positioned in between the two standard sleeves adjacent the floor. Two outriggers extend from in between the two standard sleeves to an outrigger bracket which is mounted on the wall. Preferably, the two outriggers are positioned in the general vicinity of the top and the bottom of the vertical standards. The outrigger and the outrigger bracket allow for adjustment of the system with respect to the wall. A top rail extends across the top of the perimeter standards. The display system provides for adjustment of both the height and the distance away from the wall to accommodate irregularities in the floor and the wall surfaces of a store.

DESCRIPTION OF THE DRAWINGS

The above-mentioned and other features and advantages of the structural and procedural aspects of the present invention are set forth in and made apparent by the following Detailed Description of the Invention when considered in connection with the accompanying drawings, wherein.

DETAILED DESCRIPTION OF THE INVENTION

Figure 1A:
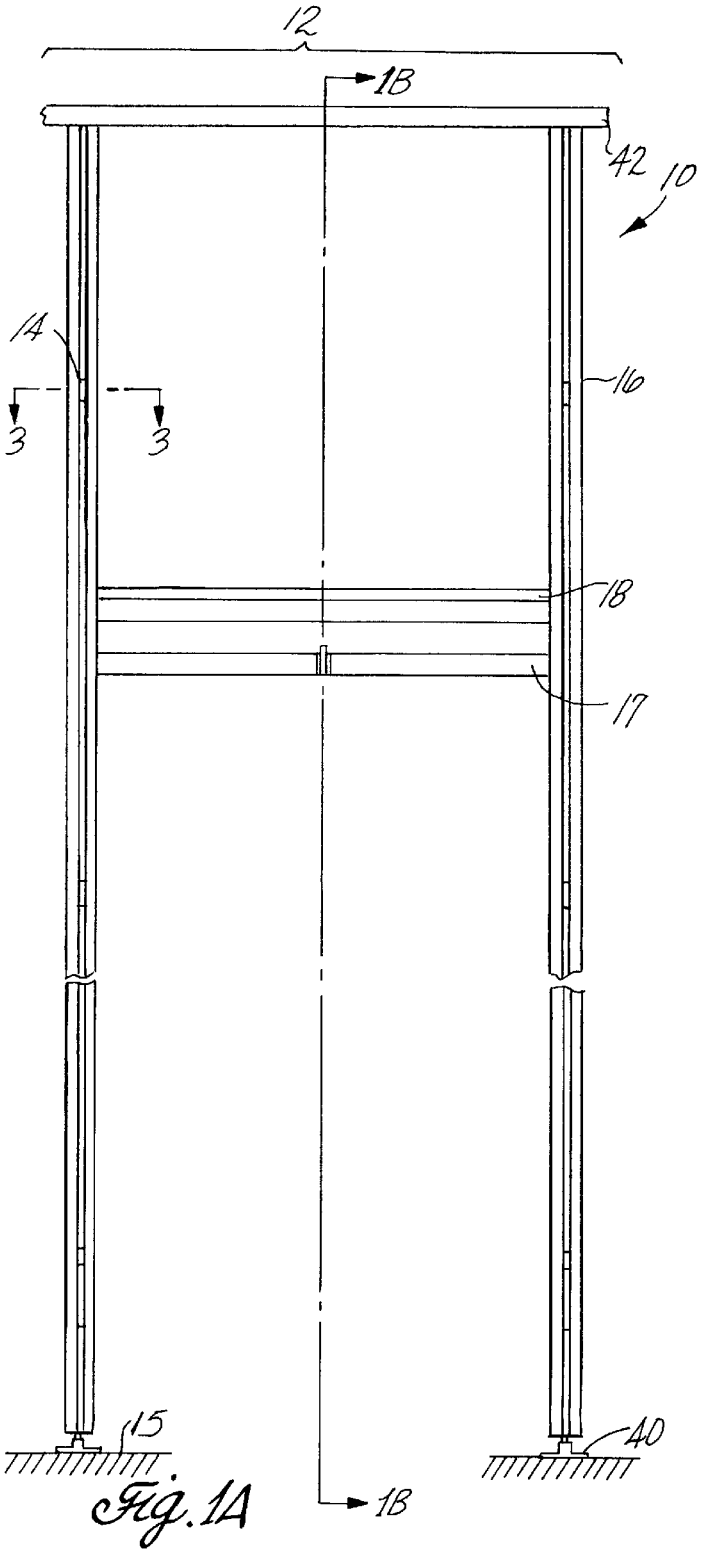
FIG. 1A is a front view of one section of a modular display system of the present invention having a pair of posts cooperative with complimentary brackets to support a shelf.
Figure 1B:
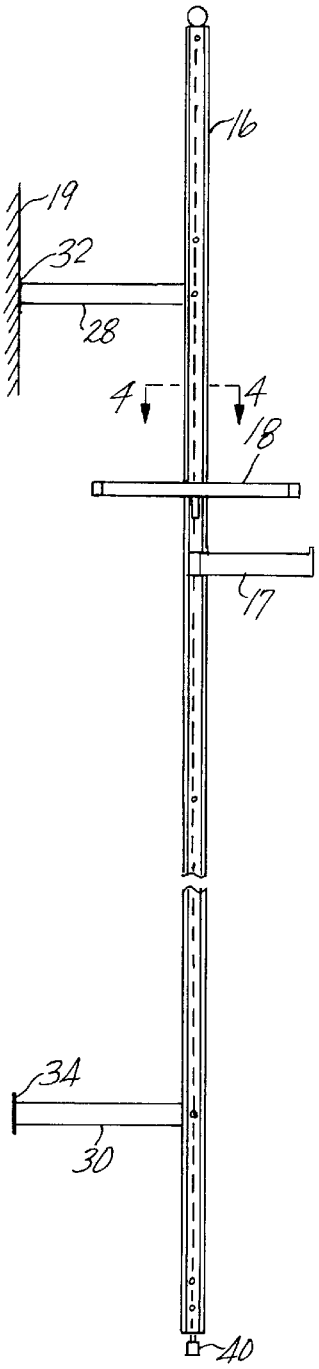
FIG. 1B is a cross-sectional side view taken along line 1B—1B of FIG. 1A.

The present invention, as shown in FIGS. 1A and 1B, is a modular display system 10 for display of clothing merchandise or other retail items. FIGS. 1A and 1B illustrate a single section 12, however, multiple sections are utilized to create a multi-section display system. The display system 10 would preferably be positioned around the perimeter walls of a retail store.

Each section 12 includes a first vertical post 14 and a second vertical post 16 attached to the floor 15. A horizontal shelf 18 is supported between the posts by brackets (not shown) attached to the shelf 18 and the first and second posts 14, 16. Similarly, a bar 17 for hanging clothes could be supported between the posts. If desired, the merchant could have multiple shelves or bars for display of merchandise.

Figure 2:
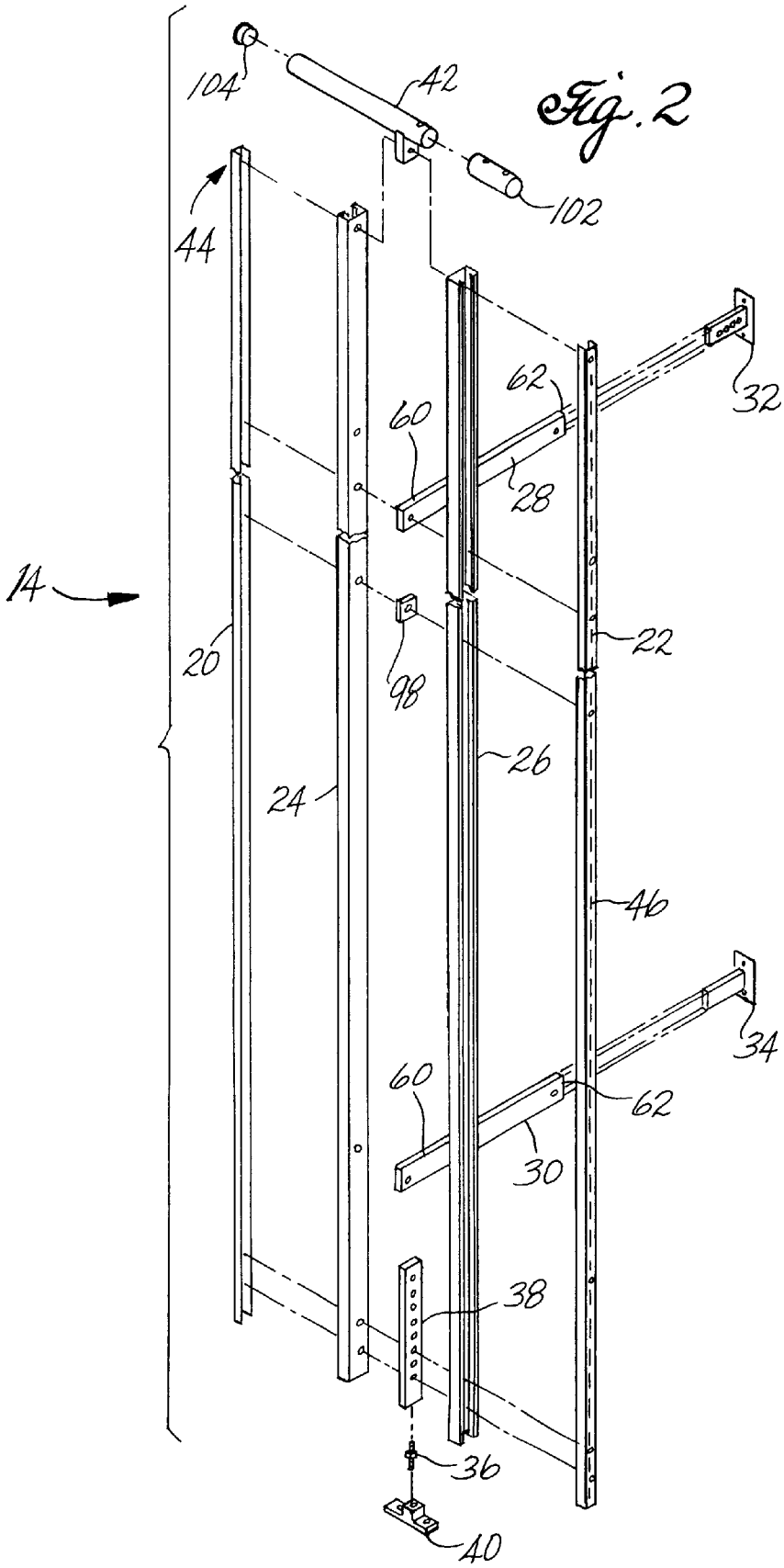
FIG. 2 is an exploded perspective view of one post of the modular display system shown in FIGS. 1A and 1B.

FIG. 2 is an exploded view of one of the vertical posts of the modular display system. In the preferred embodiment, each post includes a first and second perimeter standard 20, 22, a first and second perimeter standard sleeve 24, 26, a first and second outrigger 28, 30, a first and second outrigger bracket 32, 34, a leveler adjustment screw 36, a leveler arm 38 and a foot bracket 40. The display system 10 may also have a top cap 42 at the top portion of the display. Each of these elements is discussed in further detail below.

Perimeter standards 20, 22 are typically provided with a plurality of aligned or vertically spaced slots 46 dimensioned to receive seating hooks of a bracket (not shown) in interlocking engagement with the standards. Upon installation of the brackets, horizontal shelves 18 (FIGS. 1A and 1B) for the display of merchandise can be connected to the brackets in a suitable fashion.

Figure 4:
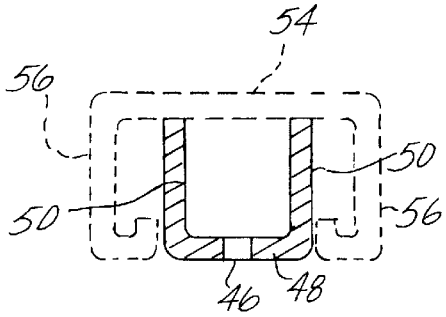
FIG. 4 is a cross-sectional view of the perimeter standard of the modular display system shown in FIG. 1B taken along line 4—4.

As shown in FIG. 4, the perimeter standard is U-shaped in cross-section and includes a face 48 and two arms 50 extending from the face 48. The vertically spaced slots 46 are disposed in, and extend through, the face 48 of the perimeter standard.

Figure 3:
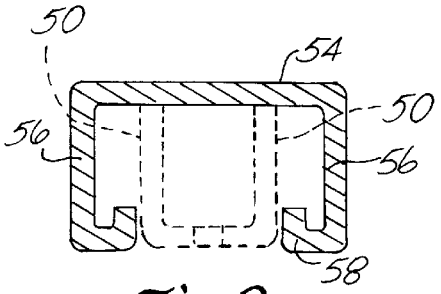
FIG. 3 is a cross-sectional view of the sleeve of the modular display system shown in FIG. 1A taken along line 3—3.

As shown in FIG. 2, each perimeter standard 20, 22 is positioned in and is supported by a perimeter standard sleeve 24, 26, respectively. The sleeves are vertically positioned to provide structural rigidity for the standards. As shown in FIG. 3, the sleeve includes a base 54 and two arms 56 extending outwardly from the base 54. Each perimeter standard is slidably engaged with the perimeter sleeve such that the end of the standard arms 50 are in contact with the sleeve base 54 and the sleeve arms 56 are substantially parallel to and adjoining the standard arms 50. In the preferred embodiment, the sleeve arms 56 are bent inward to form a pair of grips 58. The grips 58 ensure that the standard is firmly held in place.

Figure 5:
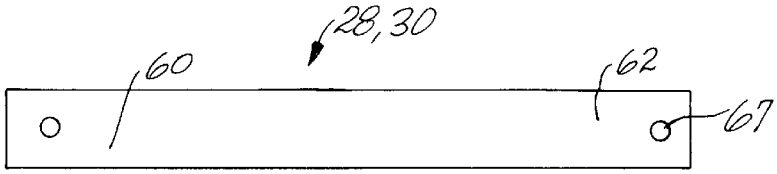
FIG. 5 is a side view of the perimeter outrigger of the modular display system shown in FIGS. 1B and 2.

The modular display system 10 is anchored to a wall 19 or other vertical support by outrigger 28, 30 and brackets 32, 34. Although it is possible to attach the display system to the wall using a single outrigger and a single bracket, in the preferred embodiment two outriggers 28, 30 and two outrigger brackets 32, 34 are used. The outrigger, as best seen in FIG. 5 is a 35 rectangular support manufactured from a rigid material having a first end 60 and a second end 62. As shown in FIG. 2, the first end 60 of the outriggers 28, 30 is positioned between the first sleeve 24 and the second sleeve 26. The perimeter standards 20, 22, the perimeter standard sleeves 24, 26, and the outriggers 28, 30 are fastened together by suitable hardware, or less preferably by welding. In the embodiment shown, the perimeter standards 20, 22, the perimeter standard sleeves 24, 26, and the outriggers 28, 30 all include apertures therein such that when the apertures are aligned, a bolt can be inserted therethrough and in combination with a nut can secure the individual parts together.

Figure 6A:
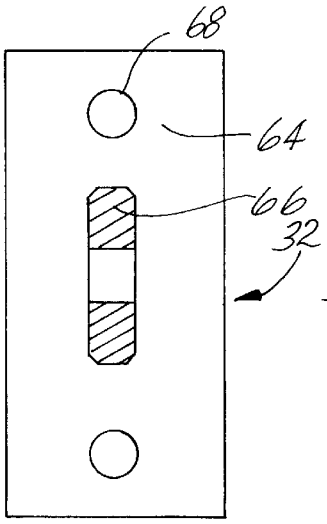
FIGS. 6A and 6B are front and side cross-sectional views of the outrigger bracket of the modular display system shown in FIG. 2.
Figure 6B:
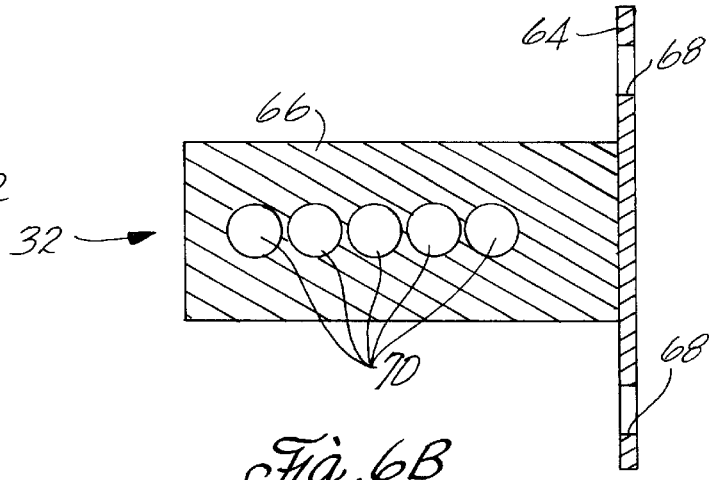

Outrigger brackets 32, 34 are used to attach the outriggers 28, 30 to a wall or other vertical support. In the preferred embodiment, the first outrigger bracket 32 has a different design than the second outrigger bracket 34. The first outrigger bracket 32, as shown in FIGS. 6A and 6B, includes a bracket base 64 and a bracket arm 66 extending perpendicularly from the base 64. The bracket base 66 defines apertures 68 therein for rigidly mounting the bracket arm 64 to a wall or other vertical support 19 (FIG. 2). The mounting can be accomplished using known fastening means.

The bracket arm 66 also defines a plurality of apertures 70 therein. An aperture 67 (FIG. 5) in the second end 62 of the first outrigger 28 is aligned with one of the apertures 70 in the bracket arm 66 and fastened thereto using known fastening means. The distance between the wall and the display system can be adjusted by choosing from the plurality of apertures 70 in the bracket arm 66. The outrigger is hollow or includes an opening in the second end 62 for insertion of the bracket arm 66.

Figure 7A:
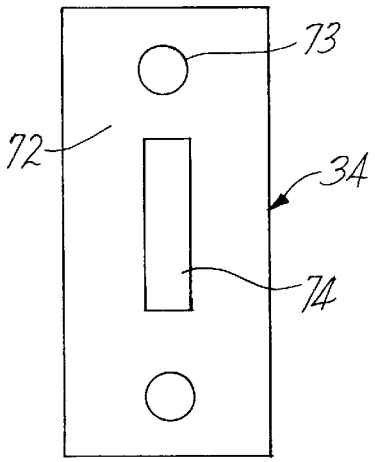
FIGS. 7A and 7B are front and side views of an alternative embodiment of an outrigger bracket for the modular display system shown in FIG. 2.
Figure 7B:
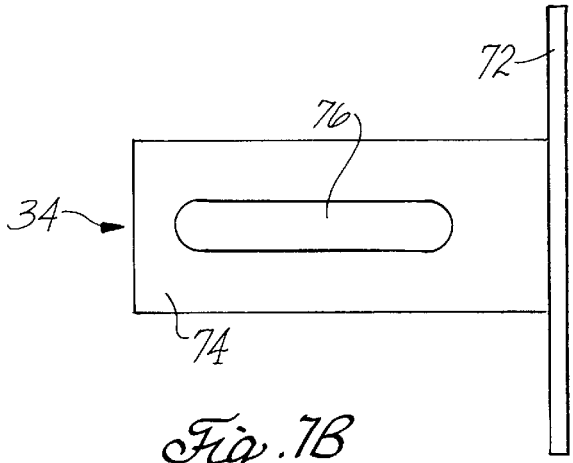

The outrigger bracket 34 for the second outrigger 30 is shown in FIGS. 7A and 7B. The base 72 of the second outrigger bracket 34 is similar to the base 66 of the first outrigger bracket and includes apertures 73 therein for mounting to a wall or other vertical support 19. The second outrigger base 72 also includes a bracket arm 74 extending therefrom. A slot 76, disposed in the bracket arm 74, is used to attach the second outrigger 30 to the second bracket arm 34. In the preferred embodiment, an aperture 67 in the second end 62 of the second outrigger 30 is aligned with the slot 76. The length of the slot 76 defines the alignment positions within the slots to allow for the compensation of irregularities found in the surface of the walls. For instance, if the wall has a concave irregularity or slopes inward, the outrigger is fastened in the slot at a location further from the wall. This adjustment compensates for any irregularities in the wall surface. Conversely, if the wall has a convex irregularity or slopes outward, the outrigger is fastened in the slot at a location closer to the wall. Once again, this ensures that the display system remains in a stable upright position. Again the bracket extends into the hollow end of the outrigger.

The outriggers can be fastened to the outrigger brackets using known fastening means. For example, once the aperture in the outrigger is aligned with the aperture or slot in the outrigger bracket, a bolt can be threaded therethrough and in combination with a nut can bind the outrigger to the outrigger bracket.

Figure 9:
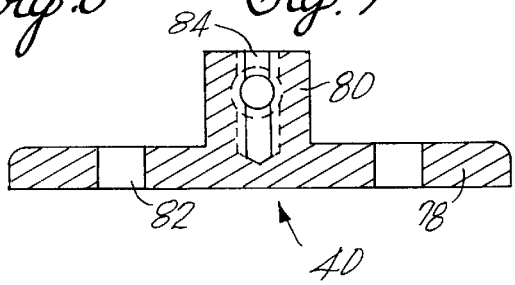
FIG. 9 is a side cross-sectional view of the foot bracket of the modular display system shown in FIGS. 1A and 1B.

A foot bracket 40 is used to support the display system on the bottom and to anchor the system to the floor. The foot bracket 40, as shown in FIG. 9, includes a foundation 78 and a shoulder 80. The foundation 78 stably rests on the floor and preferably contains apertures 82 therein for bolting the foot bracket to the floor 15. The shoulder 80 contains an internally threaded cavity 84 therein for receiving the leveler adjustment screw 36.

Figure 10:
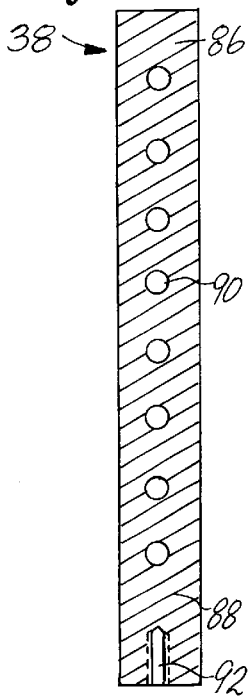
FIG. 10 is a side cross-sectional view of the leveler arm of the modular display system shown in FIG. 2.

Height of the system is adjusted by a leveler arm 38 and the adjustment screw 36. The leveler arm 38 has a first end 86 and second end 88 as shown in FIG. 10. The first end 86 is positioned between the first and second sleeves 24, 26, and the second end 88 extends vertically downward therefrom. The leveler arm 38 includes a plurality of apertures 90 therein for adjusting the height of the display system 10. The leveler arm 38 is fastened to the standards 20, 22 and sleeves 24, 26 in a manner similar to the fastening of the outriggers 30, 32. Namely, apertures in the leveler arm 38, standards 20, 22 and sleeves 24, 26 are aligned and a bolt threaded therethrough, in combination with a nut, secures the individual parts together.

Figure 11:
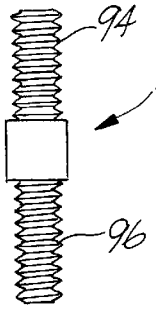
FIG. 11 is a side view of the leveler screw of the modular display system shown in FIG. 2.

An internally threaded cavity 92 is disposed in the second end 88 of the leveler arm 38. The leveler adjustment screw 36 is used to fasten the leveler arm 38 to the foot bracket 40. The adjustment screw 36, as shown in FIG. 11, has a first section 94 and a second section 96. The first section 94 of the adjustment screw 36 has external threads corresponding to the internally threaded cavity 92 of the leveler arm 38. The second section 96 of the adjustment screw 36 has external threads corresponding to the internally threaded cavity 84 of the foot bracket 40. The height of the display system 10 can be further adjusted by controlling the extent to which the adjustment screw 36 is threaded in the foot bracket cavity 84 and the leveler arm cavity 92. The ability to adjust the height of the display system is useful in accommodating irregularities in the floor surface. If there is a protrusion or if the floor is sloped upward, the adjustment screw 36 can be threaded further into the bracket and leveler arm cavities. The shorter display length will accommodate the protruding irregularity or the upward slope of the floor. In contrast, if there is a recessing irregularity or a downward slope, the adjustment screw 36 is threaded less into the bracket and leveler arm cavities, thus increasing the height of the display system. The taller display length will accommodate the recessing irregularity or the downward slope of the floor. Major irregularities are compensated for by the positioning of the leveler arm, and fine adjustments are accomplished through the adjustment screw.

Figure 8:
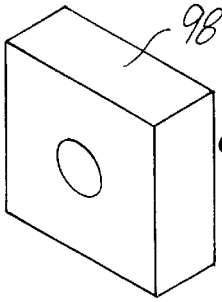
FIG. 8 is a perspective view of a spacer of the modular display system shown in FIG. 2.

To ensure the structural rigidity of the display system 10, a spacer member 98 is placed between the first and second sleeves, preferably in the middle portion of the display system. The placement of the leveler arm 38, and the outriggers 28, 30 between the first and second sleeve 24, 26 creates a gap between the sleeves. Under stress, the sleeves could bend and collapse into the gap, especially in the middle portion of the display system. To avoid this failure, a spacer member 98 is placed between the first and second sleeve. The spacer member 98, shown in FIG. 8, is preferably square, with the length of the side equal to the width of the sleeves 24, 26. An aperture is disposed in the spacer member 98 to facilitate the fastening of the spacer member 98 to the sleeves 24, 26 and the standards 20, 22. The fastening can be accomplished using known means as described above.

Figure 12:
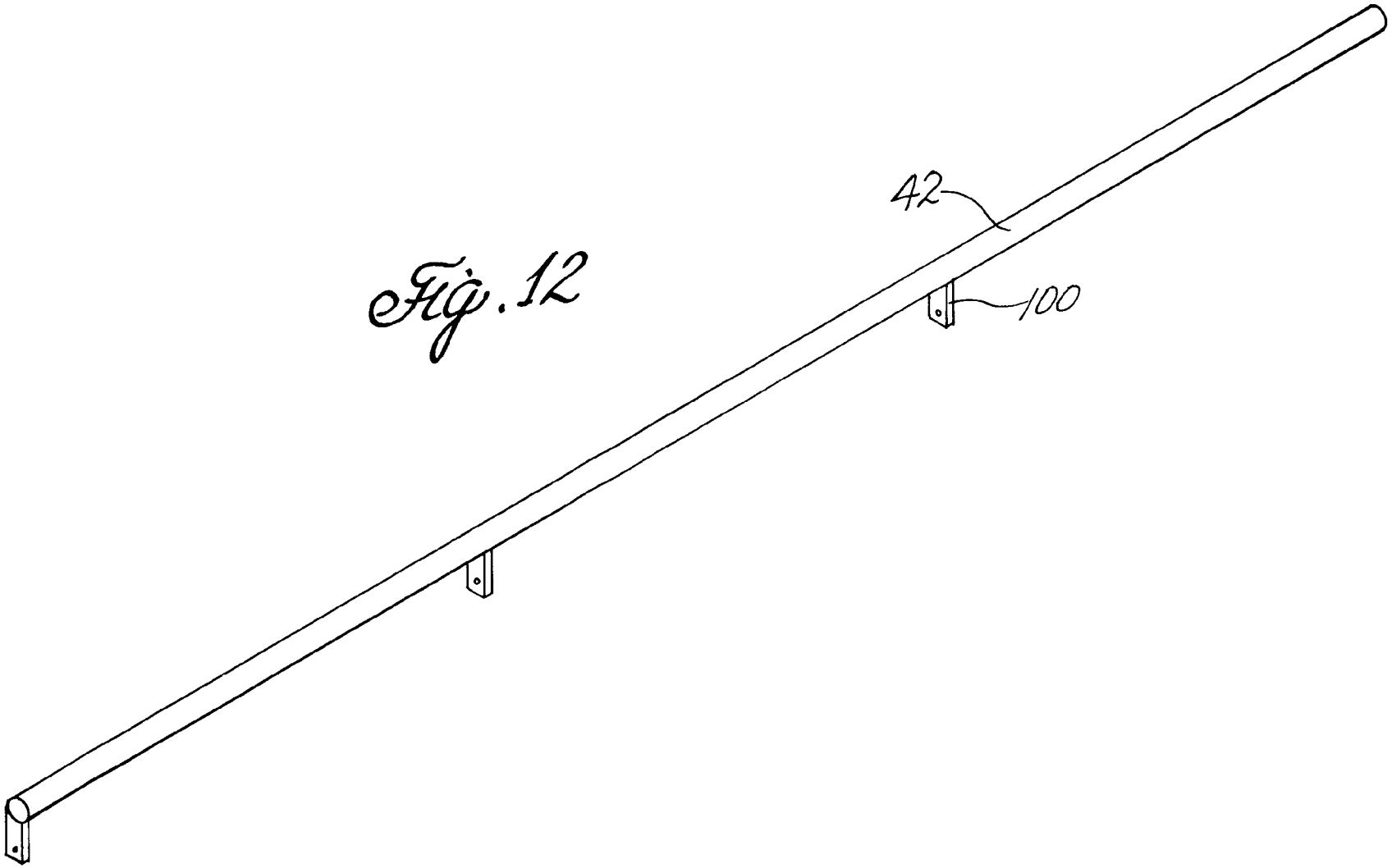
FIG. 12 is a perspective view of the perimeter top rail of the modular display system partially shown in FIG. 1A.

A top cap 42 is installed at the top of the display system 10 to further ensure the structural rigidity of the system. As shown in FIG. 12, the top cap 42 preferably has a cylindrical shape and extends across the width of the display system 10. Several tabs 100 extend outward from the top cap 42 to facilitate attaching the top cap to the display system. If there are more than one sections in the display system, top caps can be attached together using a top cap sleeve 102, as shown in FIG. 2. If there are no further connections between top caps, an end cap 104 is used to seal the end of the top cap (FIG. 2).

To create a multi-sectional display system, additional posts can be added. For instance, by adding a third post, a retail merchant can create two sections. As best seen in FIG. 2, each post has two standards, one disposed on each side of the post. The standard at one side could be used with a second post to form a section. The standard at the other side could be used with a third post to form a second section. Accordingly, a single post can be utilized in two sections. The modular display system can be manufactured using any rigid material including metal, wood, plastic or any other rigid material, either individually or in combination with other materials.

While various embodiments of this invention have been shown and described, it would be apparent to those skilled in the art that many modifications are possible without departing from the inventive concept disclosed herein. It is therefore to be understood that this invention may be practiced otherwise than as specifically described.

What is claimed is:

1. A modular display system for display of clothing merchandise and other retail items comprising at least two vertical posts, each post comprising:

a first sleeve and a second sleeve;

a first perimeter standard slidably engaged with the first sleeve and a second perimeter standard slidably engaged with the second sleeve, the first and second perimeter standards provided with a plurality of vertically spaced slots therein;

a first outrigger having a first end and a second end, the first end of the outrigger positioned between the first and second sleeves, the second end extending horizontally from the first end;

a first outrigger bracket having a base and a projecting arm, the base attachable to a vertical support, the projecting arm adjustably attachable to the second end of the first outrigger;

a foot bracket having a foundation and a shoulder, the foundation resting on a floor, the shoulder having an internally threaded cavity therein;

a leveler arm having a first end and a second end, the first end of the leveler arm positioned between the first and second sleeve, the second end of the adjustment arm having an internally threaded cavity therein; and an adjustment screw having a first section and a second section, the first section having external threads corresponding to the internal threads of the leveler arm, and the second section having external threads corresponding to the internal threads of the foot bracket.

2. The modular display system of claim 1 wherein each of the first and second perimeter standards further comprises a face, a pair of arms outwardly extending from the face, and a plurality of vertically spaced slots disposed on the face.

3. The modular display system of claim 2 wherein each of the first and second sleeves further comprises a base and a pair of arms extending outwardly from the base, the first and second sleeves slidably engaged to the first and second perimeter standards, respectively, such that the end of the arms of the perimeter standards are in contact with the base of the sleeves and the arms of the perimeter standards are substantially parallel to the arms of the sleeves.

4. The modular display system of claim 3 wherein the arms of the first and second sleeves bend inwards to form a grip.

5. The modular display system of claim 1, further comprising a top cap positioned at the top of the first and second sleeves.

6. The modular display system of claim 5 wherein the top cap has a cylindrical shape.

7. The modular display system of claim 5, further comprising a top cap sleeve to facilitate the connection of the top cap to another top cap.

8. The modular display system of claim 5, further comprising an end cap positioned at an end of the top cap.

9. The modular display system of claim 1 wherein each post further comprises:

a second outrigger having a first end and a second end, the first end of the second outrigger positioned between the first and second sleeves, the second end extending horizontally from the first end; and a second outrigger bracket having a base and a projecting arm, the base attachable to a vertical support, the projecting arm adjustably attachable to the second end of the second outrigger.

10. The modular display system of claim 1, further comprising a spacer positioned between the first and second sleeve to provide structural support.

11. The modular display system of claim 1 wherein the projecting arm of the outrigger bracket defines a plurality of apertures therein to facilitate the adjustable fastening of the outrigger bracket to the outrigger.

12. The modular display system of claim 1 wherein the projecting arm of the outrigger bracket defines a slot therein to facilitate the adjustable fastening of the outrigger bracket to the outrigger.

13. The modular display system for attachment to a wall surface comprising:

at least two vertically extending posts spaced apart parallel to one another, each post further comprises a first sleeve, a second sleeve and at least one perimeter standard slidably engaged with each sleeve;

at least one horizontal support for each post positioned between the first sleeve and the second sleeve for connecting the post to the wall surface;

a foot assembly attached to each post for adjusting a height of the vertical posts;

a bracket connected to the at least one horizontal support for adjusting the distance of the posts away from the wall; and a lateral support extending and connected between the posts for display of merchandise.

14. The modular display system of claim 13 wherein the bracket is attachable to the wall surface and to the at least one horizontal support.

15. The modular display system of claim 14, wherein the bracket defines a plurality of appertures therein to facilitate the adjustable fastening of the bracket to the at least one horizontal support.

16. The modular display system of claim 14, wherein the bracket defines a slot therein to facilitate the fastening of the bracket to the at least one horizontal support.

17. The modular display system of claim 13 wherein the at least one horizontal support comprises at least one outrigger horizontally attached to each post.

18. The modular display system of claim 13 wherein the foot assembly further comprises:

a foot bracket having an internally threaded cavity therein;

a leveler arm, having a first end and a second end, the first end attached to the post, the second end having an internally threaded cavity therein; and an adjustment screw having a first section and a second section, the first section having external threads corresponding to and threadingly engaged to the internal threads of the leveler arm, and the second section having external threads corresponding to and threadingly engaged to the internal threads of the foot bracket.

19. The modular display system of claim 13 wherein the lateral support extending between the posts comprises a shelf.

20. The modular display system of claim 13 wherein the lateral support extending between the posts comprises a bar.

* * * * *